US008913934B2

(12) United States Patent
Cardoso et al.

(10) Patent No.: US 8,913,934 B2
(45) Date of Patent: Dec. 16, 2014

(54) COLD PRESSURE TRANSFIX IN A SIMPLIFIED PRINTER

(75) Inventors: George C Cardoso, Webster, NY (US); John F Knapp, Fairport, NY (US); Rachael L Mcgrath, Churchville, NY (US); Dale R Mashtare, Bloomfield, NY (US)

(73) Assignee: Xerox Corporation, Norwalk, CT (US)

( * ) Notice: Subject to any disclaimer, the term of this patent is extended or adjusted under 35 U.S.C. 154(b) by 807 days.

(21) Appl. No.: 12/831,300

(22) Filed: Jul. 7, 2010

(65) Prior Publication Data

US 2012/0008996 A1 Jan. 12, 2012

(51) Int. Cl.

| | |
|---|---|
| ***G03G 15/16*** | (2006.01) |
| ***G03G 15/20*** | (2006.01) |
| ***G03G 15/00*** | (2006.01) |
| *G03G 15/24* | (2006.01) |

(52) U.S. Cl.

CPC ..... *G03G 15/2092* (2013.01); *G03G 15/751* (2013.01); *G03G 15/24* (2013.01); *G03G 2215/168* (2013.01); *G03G 2215/0129* (2013.01); *G03G 2215/169* (2013.01); *G03G 2215/1695* (2013.01)

USPC ..... 399/307; 399/148; 399/318; 399/339; 430/124.23

(58) Field of Classification Search

CPC . G03G 15/2092; G03G 15/24; G03G 15/751; G03G 2215/1676; G03G 2215/168; G03G 2215/1685

USPC ..... 399/66, 67, 121, 122, 148, 297, 302, 399/307, 308, 318, 320, 339; 430/124.23

See application file for complete search history.

(56) References Cited

U.S. PATENT DOCUMENTS

| | | | | |
|---|---|---|---|---|
| 3,854,975 | A | 12/1974 | Brenneman et al. | |
| 3,988,061 | A | 10/1976 | Root | |
| 4,339,194 | A | 7/1982 | Scribner | |
| 4,444,486 | A | 4/1984 | Monkelbaan | |
| 4,448,872 | A * | 5/1984 | Vandervalk | 430/125.32 |
| 6,785,501 | B2 * | 8/2004 | Hongawa et al. | 399/307 |
| 2008/0219714 | A1 * | 9/2008 | Mashtare et al. | 399/302 |

FOREIGN PATENT DOCUMENTS

| | | | | |
|---|---|---|---|---|
| JP | 60235179 | A * | 11/1985 | G03G 15/20 |

* cited by examiner

*Primary Examiner* — Benjamin Schmitt

(57) ABSTRACT

A system to combine the transfer and fixing xerographic steps of a xerographic printer into one, as well as to eliminate the need for an electrical field for transfer. The image is transfixed directly from a photoconductor to the paper or other suitable substrate. Appropriate pressure is applied during this step to cold-pressure fix the toner on the paper, taking into account the type of substrate and type of toner. The cold pressure transfix can be done either directly from a photoreceptor, without an intermediate transfer belt (ITB), eliminating all electrostatic transfer subsystems and a fusing operation. Alternatively, for engines with an intermediate transfer belt (ITB), the cold pressure transfix could replace a needed second transfer and fuser system.

7 Claims, 2 Drawing Sheets

COLD PRESSURE TRANSFIX IN A SIMPLIFIED PRINTER

BACKGROUND

1. Field of the Technology

Figure 1:
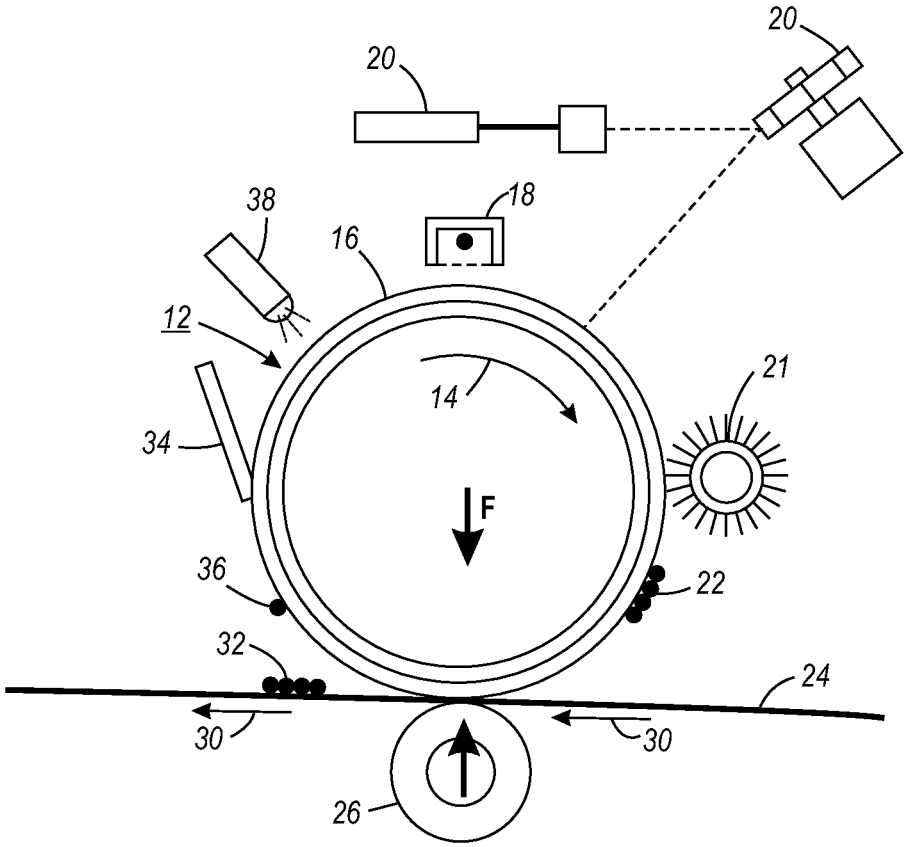

The present disclosure relates to digital printing systems, and in particular, to xerographic printers and to the simplification of the xerographic process. Key steps in the standard Xerographic printer process are the transfer and fusing/fixing of an image from a photoconductor to a substrate such as paper. The fusing of toner on paper uses more than half of the energy to operate the machine. Electrostatic transfer, itself, involves high voltages and ozone generation.

2. Description of the Prior Art

Non-thermal (cold pressure fusing) has been known as early as the late 70's and early 80's. For example, U.S. Pat. No. 4,339,194 discloses a cold pressure fusing apparatus in a xerographic device for fusing toner images on a support surface, such as a sheet of paper, by applying a plurality of pressure fusing roller strokes to a toned copy sheet.

U.S. Pat. No. 3,988,061 discloses that toner powders deposited in an image pattern on a substrate can be fixed in place by applying pressure rather than heat. This is accomplished by applying pressure in a degree normally insufficient to secure adequate fixing, but by repeating the treatment one or more times, adequate fixing is achieved. Also U.S. Pat. No. 3,854,975 discloses fixing techniques that employ the pressure developed by two hard surfaced rolls to fix toner particles on a substrate. Another proposed process passes the substrate between hard surfaced rolls in combination with the application of heat. U.S. Pat. No. 4,444,486 discloses fixing of particulate thermoplastic material arranged in image configuration by passing the substrate carrying the images between a pair of unheated pressure engaged roll members forming part of a three roll pressure fuser.

In a typical cold pressure fusing device, the substrate to receive an image is fed between two steel rolls under considerable pressure, about 1000 psi to about 10,000 psi depending on the toner design and the paper substrate. Under pressure, the toner particles yield, coalesce and are pressed into the paper. Advantages over thermal fusing include no standby power, true instant-on, durable steel rolls to last the life of the printer, improved reliability, reduced fuser service costs, fast first copy out time, process speed insensitivity, reusable fuser hardware, reduced noise (no blowers), and reduced noise and emissions.

However, prior art cold pressure fusing devices often still require an electrostatic transfer operation to move a latent image from the photoconductor to the substrate. The electrostatic transfer operation, itself, leads to its own image quality issues such as retransfer, mottle induction, Maru-hanko, fish scales, and extreme dependence on RH, substrate core condition (RH, variation in internal properties, etc) and substrate thickness. Also, electrostatic transfer does not work with conductive substrates and conductive films often used in other applications.

It is desirable, therefore, to decrease the number of subsystems and parts in the xerographic engine, as well as decrease energy use and ozone generation. It is also desirable to reduce these subsystems, not only in office and production monochrome copiers and printers, but also in very complex and quality sensitivity color printer applications.

In accordance with the present disclosure, the above advantages are extended to a wide variation of printing systems including color systems to eliminate electrostatics in the transfer system to reduce power, number of parts, and the random image defects created by electrostatic discharges.

SUMMARY OF DISCLOSURE

According to the present disclosure, there is shown a system to combine the transfer and fixing xerographic steps of a xerographic printer into one, as well as to eliminate the need for an electrical field for transfer. The image is transfixed directly from a photoconductor to the paper or other suitable substrate. Appropriate pressure is applied during this step to cold-pressure fix the toner on the paper taking into account the type of substrate and the type of toner. The high pressure, appropriate photo conductor surfaces, and suitable toner eliminate the need for an electrical transfer field.

The cold pressure transfix can be done either directly from a photoreceptor, without an intermediate transfer belt (ITB). This eliminates all electrostatic transfer subsystems and also eliminates a fusing operation. Instead, there is substituted a direct cold pressure transfix. Alternatively, for engines with an intermediate transfer belt (ITB), the cold pressure transfix could replace a needed second transfer and fuser system.

Figure 2:
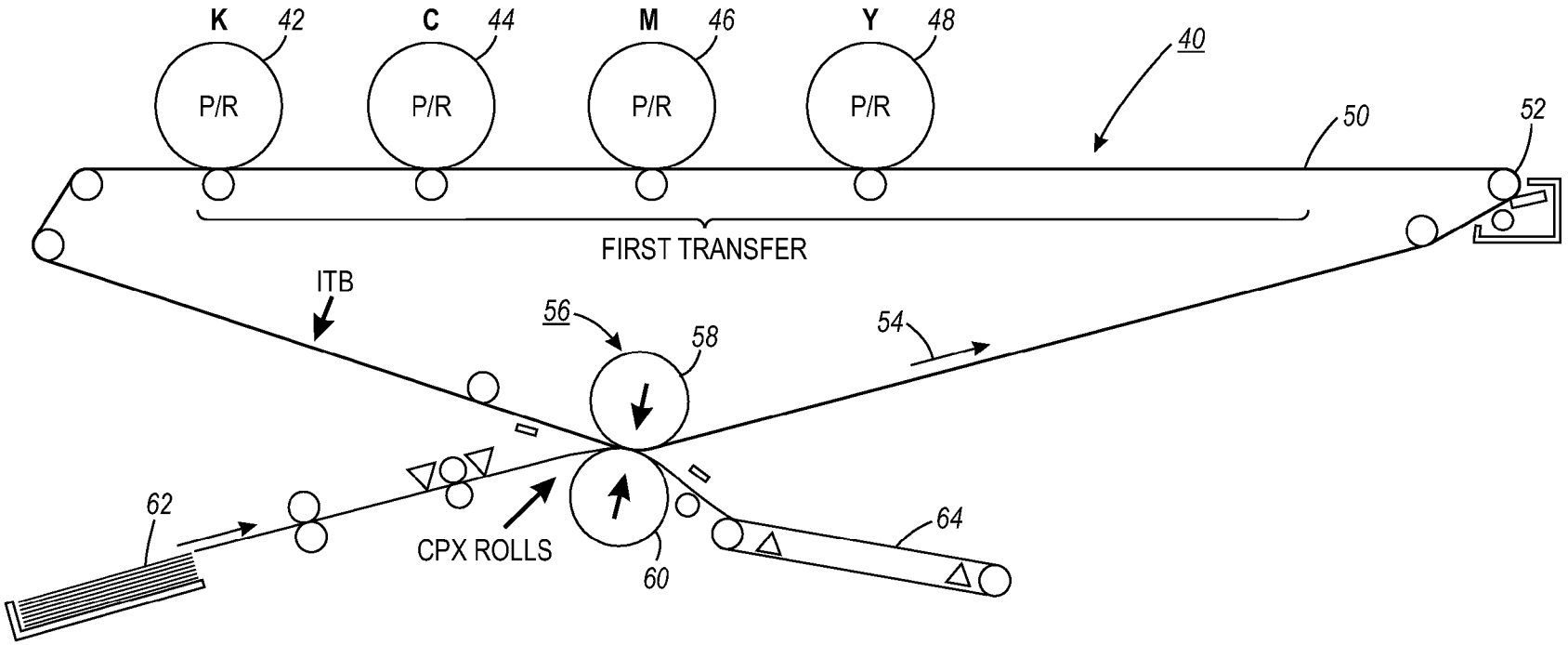

Further features and advantages will be apparent to those skilled in the art from the specific apparatus and its operation or methods described in the example(s) below, and the claims. Thus, they will be better understood from this description of these specific embodiment(s), including the drawing figures wherein:

FIG. 1 is a schematic of a cold pressure transfix (CPX) xerographic system in accordance with the present disclosure; and FIG. 2 is an alternative CPX architecture in a printer system having an intermediate transfer belt in accordance with the present disclosure.

DETAILED DESCRIPTION OF DISCLOSURE

In accordance with the present disclosure, images can be mechanically marked onto substrates such as paper directly from a photoreceptor web, drum, or other suitable photoconductive surface. High voltages transfer biases as well as the fuser are eliminated. This method, called cold pressure transfix (CPX), is a very simplified version of xerography that takes complete advantage of the advent of cold pressure fixing technology and toners. With reference to FIG. 1, there is shown a schematic view of a first embodiment of a cold pressure transfix system for a monochrome printer.

In particular, a rotating drum, generally shown at 12, is rotated in the clockwise direction, illustrated by arrow 14. The drum supports a layer or outer surface of a suitable photoconductive layer, shown at 16. It should be noted that the system could be a drum, an endless photoconductive web, or any other suitable configuration.

In the order of the cold pressure transfix operation, the first step is a charger, shown at 18, to provide an electrostatic charge to the photoconductive surface 16. The charged surface 16 is exposed to an image projected by optics, such as a raster output scanner, shown at 20. The image is then developed on the photoconductive surface by suitable application of toner by a developer shown at 21. The toner image, shown at 22 is then transported to the cold pressure transfix station illustrated generally at pressure roller 26 and the nip formed by the engagement of the drum 12 and a pressure roller 26, to apply cold pressure on paper as illustrated by the vertical arrows labeled F.

In accordance with the present disclosure, the engagement of the pressure roller 26 and the drum 12 presses or fixes the image 22 onto a suitable substrate such as paper. The paper moving from right to left as shown by arrows 30 is conveyed to the station 26 along paper path 24, receives an image, illustrated at 32, in the nip and is conveyed to an output or other suitable finishing tray. Thus, the imaging and fixing of an image on paper has been completed at this single stage.

The only other xerographic steps needed is a standard cleaning procedure, a blade shown at 34 to wipe excess toner, illustrated at 36, from the photoconductive layer 16 to provide a toner free surface for the next image. A final step is an erase lamp, shown at 38 to uniformly discharge the photoconductive layer 16 to set the layer at a base condition for the start of the next cycle of charge and imaging.

The pressures at the nip of the drum 12 and pressure roller 26 needed for CPX are typically from 3 kpsi to 6 kpsi at room temperature, compatible with organic photoconductors (or photoconductive layers) and compatible toners. In accordance with the present disclosure, an important requirement for cold pressure transfix is the compatibility of the amount of cold pressure in relation to temperature, the photoconductor material, and the toner material.

Warming up the photoconductor can be a consideration for the appropriate mix of pressure, toner, and photoconductor surface in accordance with the present disclosure. Lower pressures, for example, and/or better fix levels are possible if the photoconductor is warmed up to a temperature higher than room temperature (between 20° C. and 150° C.).

Also, conventional organic photoconductors cannot operate in high temperature environments. They are prone to deterioration at temperatures as low as 60° C. Amorphous silica drums, on the other hand, can maintain their operating characteristics even after storage at temperatures of 200° C. For higher photoconductor temperatures, amorphous silica photoconductors are preferred.

Since no electric field is involved with the transfer process conductive films and conductive materials can be used as printing substrates. In addition, the transfer becomes independent of the detailed electrical properties of the substrate, opening up a great deal of latitude across substrates, environments and material aging. A further advantage of CPX is that very thick substrates can also be successfully used for printing, as opposed to the conventional xerographic transfer techniques. As a xerographic system is often a complex set of compromises between subsystems, CPX affords the opportunity to shift this balance and create a much more robust overall system.

Traditional xerographic fusers are not appropriate for very thin substrates for the substrates can burn or melt. CPX, however, can handle thin film substrates, and is suitable for both thin and metallic substrates, increasing the options for substrates in any product or printing system.

With reference to FIG. 2, there is shown a schematic view of a second embodiment of a cold pressure transfix system, for a full color printer. In particular, there is illustrated a color printer generally shown at 40, including four separate developer stations, illustrated at 42 for developing black toner, at 44 for developing cyan toner, at 46 for developing magenta toner, and at 48 to develop yellow toner. These stations represent a first or conventional transfer operation labeled "First Transfer."

These developers are situated along and endless photoconductor belt as shown at 50, driven by belt drive 52. This belt is an intermediate transfer belt, labeled by the arrow ITB, for the first transfer operation in this type of printing architecture. The toner from each of the black, cyan, magenta, and yellow toner developers is attracted to the belt in a traditional electrostatic field environment, as the belt moves in the direction of arrow 54. Also, included along the intermediate transfer belt are not shown suitable cleaning, stations.

However, in place of the standard electrostatic field at a second transfer station in this type of printer architecture, this embodiment illustrates generally at 56 a cold pressure transfix (CPX) station, also labeled by the arrow "CPX rolls," in accordance with the present disclosure. In particular a pair of CPX rolls 58 and 60 form a nip to fix the developed image on belt 50 to paper, shown at 62, as it passes through the nip and proceeds to an output station or finishing station shown at 64. It should be noted that there is no electrostatic field necessary at the nip of rolls 58 and 60.

In general, the cold pressure transfix operation has been demonstrated under varying conditions. For example, unfused toner on a Xerox DC250 intermediate transfer belt has been cold pressure transfixed onto Xerox 4200 paper. Also, in the transfer operation, the residuals of toner remaining on a drum or the intermediate belt have been very low, much lower than the residuals typically found in electrostatic transfer. Also, there is no background printed on the substrate.

It should be noted again, that, in accordance with the present disclosure, in either of the two embodiments as shown in FIGS. 1 and 2, optionally, heat can be used to improve toner fix to the substrate, such as using heated CPX rolls with temperatures between 20° C. and 150° C. Heating of the rolls can be done from within the rolls, such as using a 1,000 watt lamp or any other suitable heating device.

Heating might increase latitude for fix, gloss and color to a desired level. Alternatively a pre-heater (before the CPX process) or an optional fuser after the CPX process can be used. CPX could be then done at a lower pressure and some amount of heat can be used to compensate for the lower pressure fix level or the CPX pressure is kept the same and heat is used if a better or a different kind of gloss is required.

What is claimed is:

1. A cold pressure fusing apparatus for use in a xerographic copying machine for fixing a developed toner image to a copy sheet, comprising:

a photoconductor mounted in said machine; a driving means operatively connected to said photoconductor, the photoconductor supporting developed toner images, the photoconductor being warmed to a temperature above room temperature, a pressure roll mounted in said machine, the pressure roll in pressure contact with the photoconductor, the pressure roll and photoconductor forming a nip, a pressure at the nip being low, and the temperature of at least one of the pressure roll and photoconductor being high with respect to the other, copy sheets entering the nip to receive a developed toner image from the photoconductor, the copy sheets exiting the nip with the developed toner image fixed to the copy sheet, and the pressure roll providing suitable pressure in relationship to the toner material to fix the developed toner image to the copy sheet, wherein the suitable pressure to fix the toner image on the copy sheet is in relationship to temperature.

2. The cold pressure fusing apparatus of claim 1 with an organic photoconductor wherein the pressures at the nip are from 1 kpsi to 6 kpsi at room temperature.

3. The cold pressure fusing apparatus of claim 1 with a photoconductor able to withstand higher temperatures with respect to the pressure roll.

4. A cold pressure fusing apparatus for use in a xerographic copying machine for fixing a developed toner image to a substrate, comprising:

a photoconductor mounted in said machine; the photoconductor surface supporting developed toner images, the photoconductor able to withstand high temperatures, a pressure roll mounted in said machine, the pressure roll in contact with the photoconductor, the pressure roll and photoconductor surface forming a nip for securing developed toner images to substrates, the temperature of at least one of the pressure roll and photoconductor surface being high with respect to the other, and a pressure control for applying pressure at the nip to secure developed toner images to the substrates, a pressure at the nip being low and the photoconductor being warmed to a temperature above room temperature, the pressure roll providing pressure as a function of the type of substrate, and the toner material to secure the developed toner image to the substrate.

5. The cold pressure fusing apparatus of claim 4 wherein the pressure at the nip is a function of temperature.

6. The cold pressure fusing apparatus of claim 4 including an organic photoconductor surface wherein the pressure is between 1 kpsi to 6 kpsi at room temperature.

7. A method of providing a fixed toner image on a substrate, wherein the image is a fixed dry powder image of toner powder having a predetermined threshold pressure and wherein fixing is achieved solely by the application of pressure applied to the powder image on the substrate, comprising the steps of:

creating an electrostatic charge image pattern on a photosensitive surface;

depositing dry electrostatic toner powder upon said substrate to form the image pattern;

fixing the toner powder image to said substrate by a threshold pressure, the threshold pressure being a function of the type of substrates and the toner powder material; and applying heat at the point of fixing the powder image to the substrate.

* * * * *